US006716005B2

(12) United States Patent
Yamakawa

(10) Patent No.: US 6,716,005 B2
(45) Date of Patent: Apr. 6, 2004

(54) PUMP PROVIDED WITH DIAPHRAGMS AND AN ECCENTRIC ROTATION SHAFT

(75) Inventor: Muneharu Yamakawa, Inagi (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/253,416

(22) Filed: Sep. 25, 2002

(65) Prior Publication Data

US 2003/0068242 A1 Apr. 10, 2003

(30) Foreign Application Priority Data

Oct. 10, 2001 (JP) ..... P2001-312923

(51) Int. Cl.[7] ..... F04B 41/06; F16H 23/00
(52) U.S. Cl. ..... 417/521; 92/71; 74/60
(58) Field of Search ..... 417/523, 529, 417/269, 521, 413.1; 92/71; 74/55, 56, 60

(56) References Cited

U.S. PATENT DOCUMENTS 2,733,665 A * 2/1956 Klopp ..... 91/507
4,565,118 A * 1/1986 Girodin ..... 92/68
5,630,351 A * 5/1997 Clucas ..... 92/12.2
6,397,794 B1 * 6/2002 Sanderson et al. ..... 123/48 B

* cited by examiner

*Primary Examiner*—Charles G. Freay
(74) *Attorney, Agent, or Firm*—Whitham, Curtis & Christofferson, PC

(57) ABSTRACT

In a pump, a plurality of pump chambers are defined by a plurality of diaphragms. A pivotable member is attached to the diaphragms. A rotator is formed with a first hole having a first diameter, which is arranged eccentrically from a rotation center of the rotator, and a second hole having a second diameter smaller than the first diameter, which is formed in a bottom of the first hole. A shaft member connects the rotator and the pivotable member so as to convert a rotation of the rotator into a pivotal movement of the pivotable member for sequentially deforming each diaphragm to vary a volume of each pressure chamber. One end of the shaft member is fitted into the second hole.

2 Claims, 4 Drawing Sheets

PUMP PROVIDED WITH DIAPHRAGMS AND AN ECCENTRIC ROTATION SHAFT

BACKGROUND OF THE INVENTION

The present invention relates to a pump provided with diaphragms, and more particularly to a compact pump which is used for a sphygmomanometer or the like.

A related-art compact pump of this type (disclosed in Japanese Patent Publication No. 2002-106471A) is now described with reference to FIGS. 3 to 4B. In FIG. 3, a compact pump 1 is provided with two diaphragms 4 for defining pump chambers 3 in a casing 2 which has a rectangular shape in a plan view. Hollow fitting members 5 are provided at respective center parts on a lower face of the diaphragms 4 so as to project downward from the diaphragms 4, and there is arranged, below the diaphragms 4, a pivotable member 6 which is adapted to move the lower faces of the diaphragms 4 up and down. The casing 2 is composed of three steps, namely, an upper case 2*a*, an intermediate case 2*b*, and a lower case 2*c*, and the diaphragms 4 are held in the casing 2 in such a manner that flange portions 4*a* of the diaphragms 4 are clamped between the upper case 2*a* and the intermediate case 2*b*.

Moreover, shaft bodies 7 having intake holes 7*a* are provided on the pivotable member 6 in the vicinity of its outer peripheral ends and positioned below the respective center part of the diaphragms 4 so as to project upwardly. By tightly fitting inner faces of the hollow fitting members 5 provided on the diaphragms 4 to outer faces of these shaft members 7, the diaphragms 4 can be mounted to the pivotable member 6.

The diaphragms 4 are partly cut in the respective center parts of their bottoms in order to form air intake valve bodies 8, and there are formed through holes 9 by the cut. The through holes 9 can be opened or closed by the air intake valve bodies 8, thus constituting air intake valve sections V1.

Further, a vent hole 10 is formed in a center part of the upper case 2*a*, and two annular concave grooves 11 which open downward and communicate with the vent hole 10 are provided on a lower face of the upper case 2*a* at an outer circumference of the vent hole 10. Vent valve bodies 12 consisting of upper end portions of the diaphragms 4 are fitted by pressure to inner wall faces 11*a* of the annular concave grooves 11, thus constituting vent valve sections V2.

An eccentric rotation shaft 13 pierces through a center part of the pivotable member 6. An extended portion 14 which is extended from the intermediate case 2*b* is provided above the pivotable member 6, and a V-shaped recess 15 which opens downward is formed in a lower part of the extended portion 14. An upper end portion of the eccentric rotation shaft 13 is loosely fitted in the recess 15 so as to swing freely therein. On the other hand, a rotary body 17 is fixed to an upper end of a rotary drive shaft 16 which is rotatably supported in an upright manner at a center of a lower part of the lower case 2*c*, and there is formed, as shown in FIGS. 4A and 4B, a hole 18 in a columnar shape having a determined diameter and a determined depth on an upper face of the rotary body 17 at a position eccentric from its center position. A lower end portion of the eccentric rotation shaft 13 is loosely fitted into the hole 18 so as to swing freely therein.

A motor casing 20 which contains a motor 19 connected to the rotary drive shaft 16 is directly connected to the lower case 2*c*. The lower case 2*c* is provided with a communicating hole 21 which communicates with the motor casing 20, and in addition, air intake holes 22 are formed in a lower part of the motor casing 20 for introducing outside air into the motor casing 20.

In this state, when the rotary drive shaft 16 is driven by the motor 19 to rotate and the rotary body 17 is rotated, the eccentric rotation shaft 13 is caused to rock inside the hole 18, resulting in an eccentric rotation. This will cause a pivoting motion of the pivotable member 6 thereby to move the lower end portions of the diaphragms 4 up and down. When the lower end portion of one of the diaphragms 4, for example, is moved downward, negative pressure is generated inside the diaphragm 4, and the vent valve body 12 will be tightly fitted to the inner wall face 11*a* of the annular concave groove 11. In other words, the vent valve section V2 is closed, and the air intake valve body 8 opens the through hole 9. In this manner, the air intake valve section V1 is shifted into an open state, and air is introduced from the intake hole 7*a* into the diaphragm 4, as shown by an arrow C.

Then, when the lower end portion of the diaphragm 4 is moved upward, high pressure will be generated in the diaphragm 4, and the air intake valve body 8 closes the through hole 9, shifting the air intake valve section V1 into a closed state. At the same time, the vent valve body 12 is enlarged in diameter so as to depart from the inner wall face 11*a*, and the air is exhausted through the vent valve section V2, as shown by an arrow D. Specifically, the air exhausted from the vent valve body 12 passes the annular concave groove 11 and exhausted from the vent hole 10 to the exterior of the casing 2.

Also with the upward movement of the diaphragm 4, negative pressure will be generated in the lower case 2*c*, and the air existing in the motor casing 20 flows into the lower case via the communication hole 21, as shown by an arrow E. This generates negative pressure inside the motor casing 20, and the outside air is introduced into the motor casing 20 via the air intake hole 22, as shown by an arrow F.

In the compact pump, since the hole 18 of the rotary body 17 is formed in a columnar shape, when the eccentric rotation shaft 13 is pivoted inside the hole 18, the lower end portion of the eccentric rotation shaft 17 is violently swung with relatively large pivoting motion in a bottom portion of the hole 18. Accordingly, there will be arisen so-called rattling with loud noises.

SUMMARY OF THE INVENTION

It is therefore an object of the invention to provide a pump provided with diaphragms, which is able to prevent rattling of the eccentric rotation shaft for moving the diaphragms up and down to eliminate noises.

In order to achieve the above object, according to the present invention, there is provided a pump, comprising:

- a plurality of diaphragms, which define a plurality of pump chambers;
- a pivotable member, attached to the diaphragms;
- a rotator, formed with a first hole having a first diameter, which is arranged eccentrically from a rotation center of the rotator, and a second hole having a second diameter smaller than the first diameter, which is formed in a bottom of the first hole; and
- a shaft member, which connects the rotator and the pivotable member so as to convert a rotation of the rotator into a pivotal movement of the pivotable member for sequentially deforming each diaphragm to vary a volume of each pressure chamber, wherein one end of the shaft member is fitted into the second hole.

Preferably, a part of a circumferential edge of the first hole serves as a part of a circumferential edge of the second hole.

In this pump, owing to the small diameter hole, the pivoting motion of the one end portion of the shaft member can be made small. Therefore, the so-called rattling can be prevented, and noises can be remarkably eliminated.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
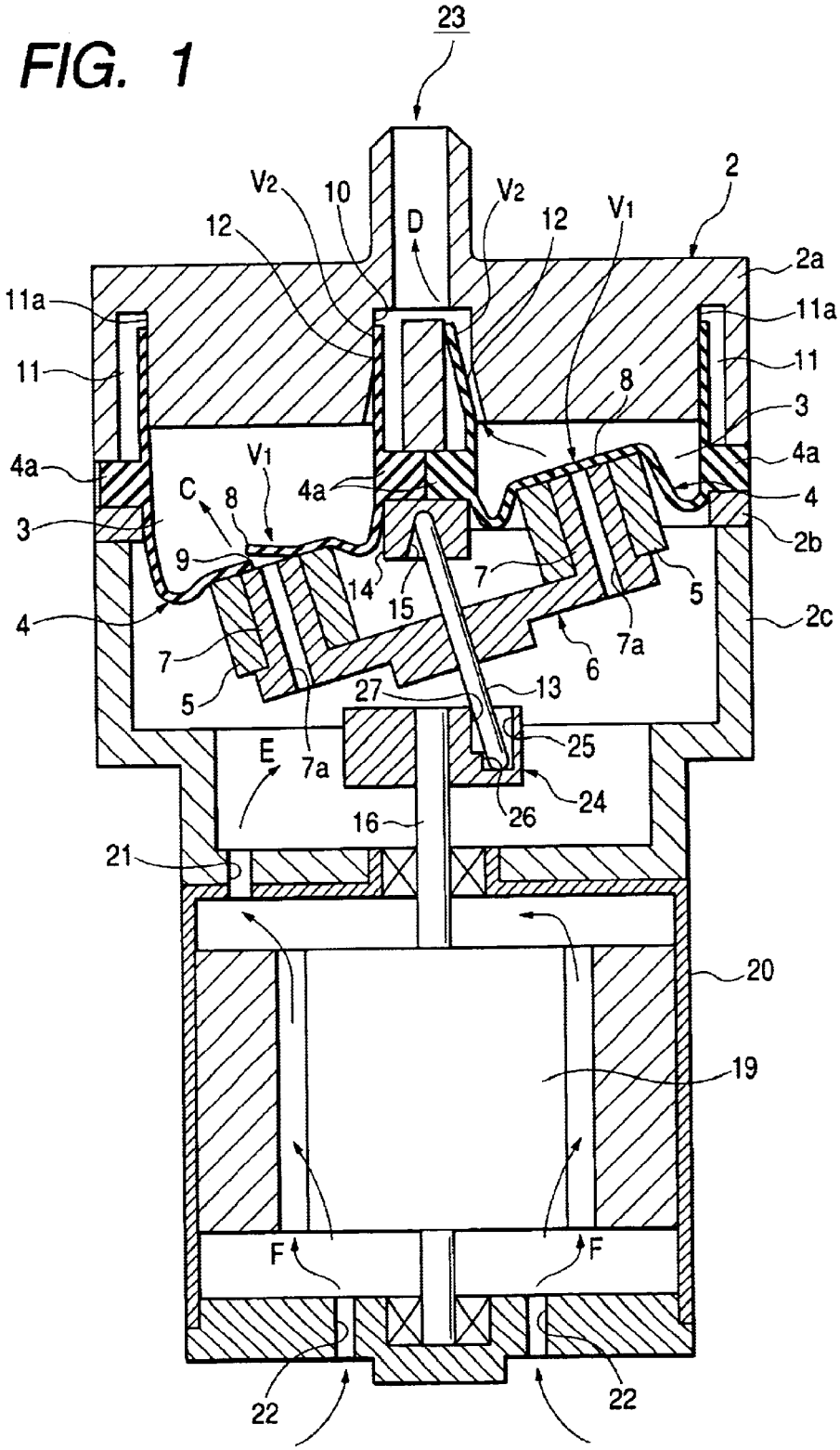
FIG. 1 is a vertical sectional view of a compact pump showing one embodiment of the present invention.

One embodiment of the present invention will be described in detail referring to FIGS. 1 and 2. It is to be noted that for convenience of explanation, the same components as those of the related-art compact pump will be denoted in the drawings with the same reference numerals, and explanation of the components will be omitted. In FIG. 1, a compact pump 23 is provided with a rotary body 24 in place of a rotary body (17 in FIG. 3) provided in the related-art compact pump (1 in FIG. 3). The rotary body 24 is eccentrically provided with a hole 25 in place of the hole (18 in FIG. 3) in the related-art compact pump.

Figure 2A:
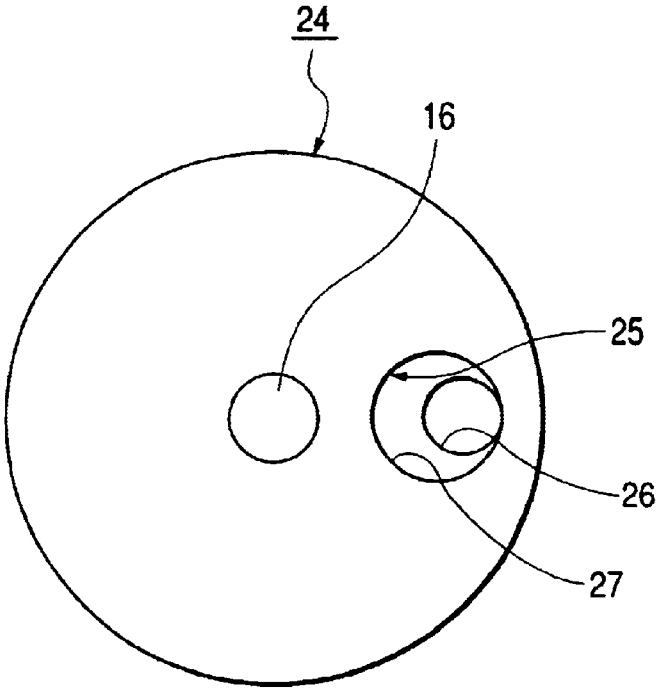
FIG. 2A is a plan view of a rotary body in FIG. 1.
Figure 2B:
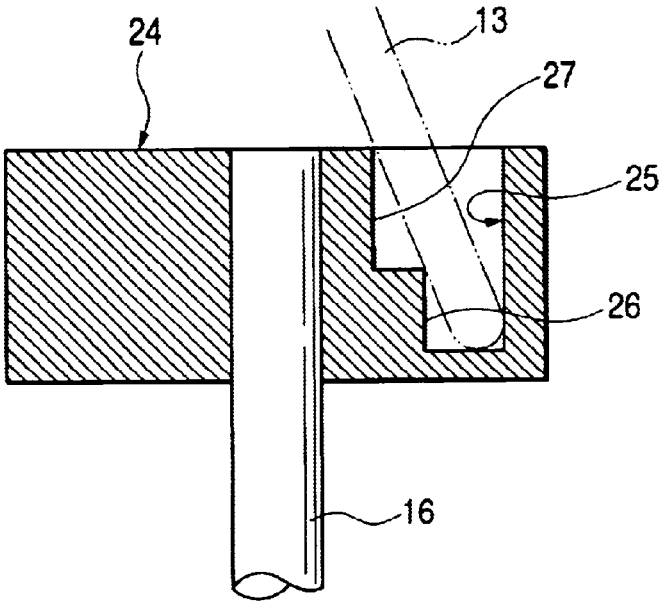
FIG. 2B is a vertical sectional view of the rotary body in FIG. 1.
Figure 3:
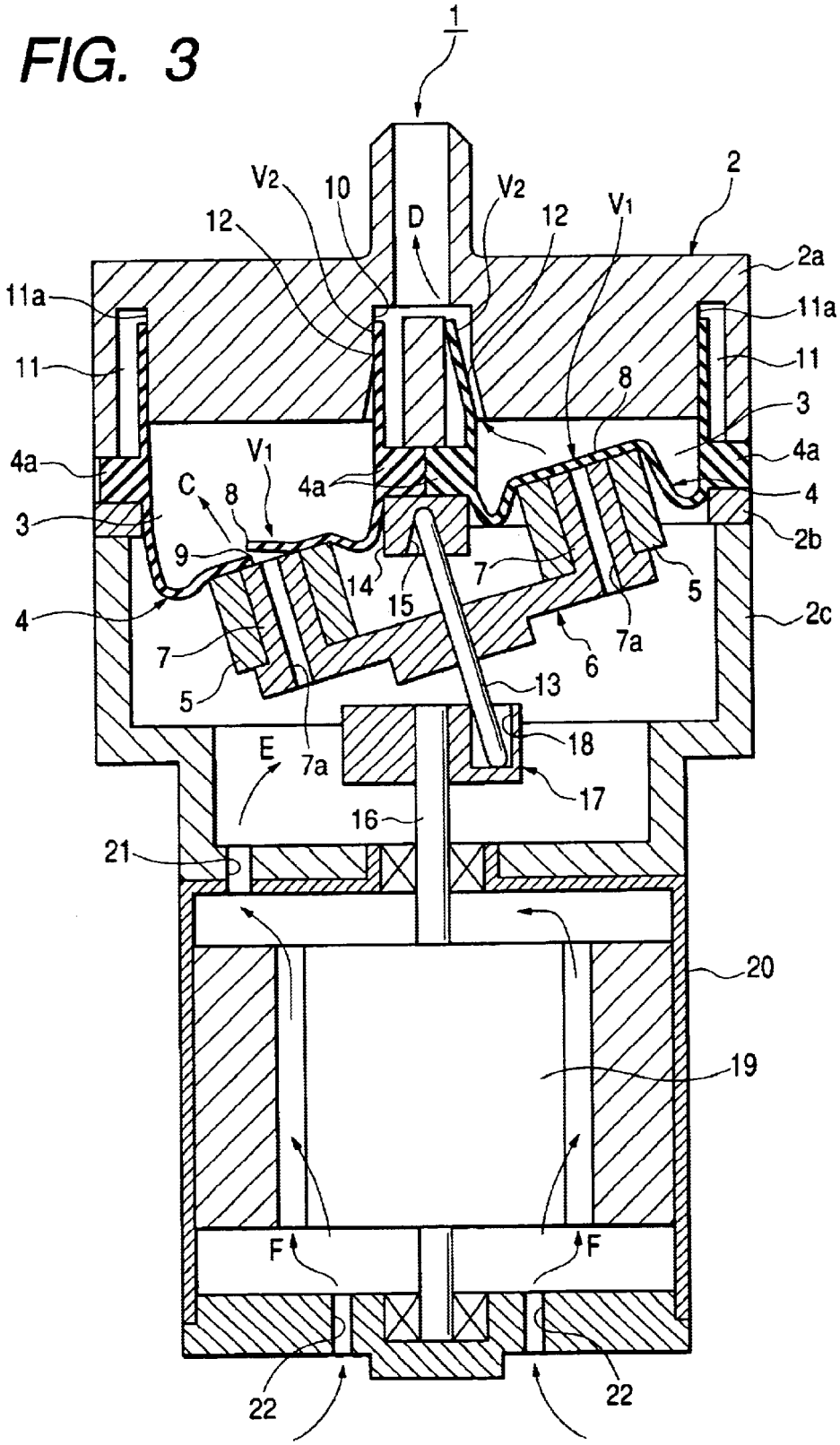
FIG. 3 is a vertical sectional view of a related-art compact pump.
Figure 4A:
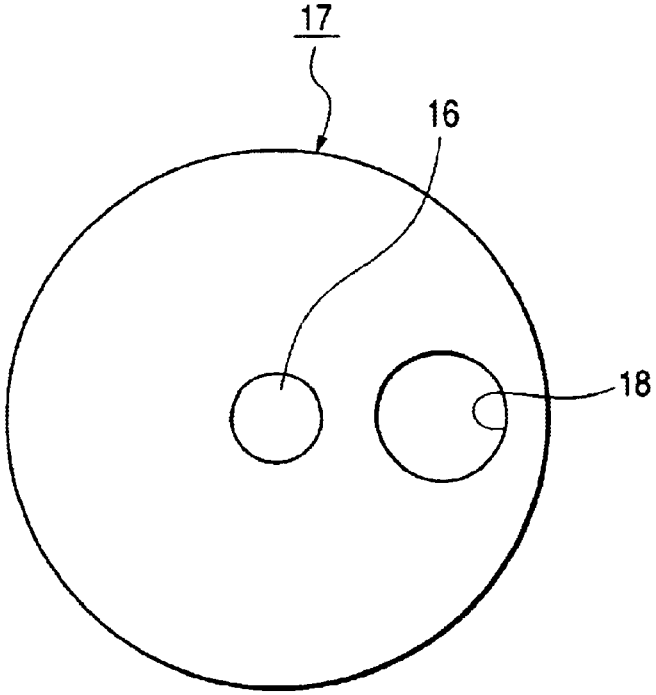
FIG. 4A is a plan view of a rotary body in FIG. 3.
Figure 4B:
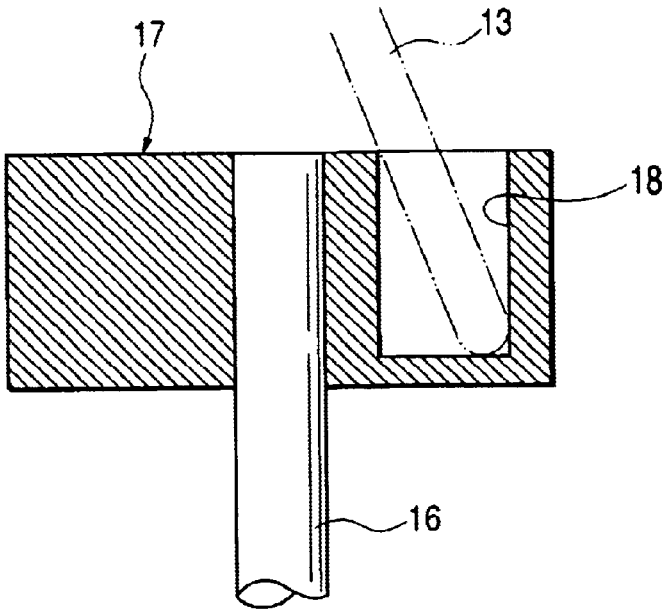
FIG. 4B is a vertical sectional view of the rotary body in FIG. 3.

As shown in FIGS. 2A and 2B, the hole 25 is formed in two steps consisting of a small diameter hole 26 in a columnar shape on a lower step and a large diameter hole 27 in a columnar shape on an upper step, in such a manner that an outer circumference of the small diameter hole 26 is substantially in contact with an inside of an outer circumference of the large diameter hole 27, at a position in the vicinity of an outer peripheral end portion of the rotary body 24. It is so constructed that the lower end portion of the eccentric rotation shaft 13 may be loosely fitted in the small diameter hole 26 so as to swing freely therein.

In this state, when the rotary body 24 is rotated with the rotation of the motor 19, the lower end portion of the eccentric rotation shaft 13 will be pivoted inside the hole 25 resulting in an eccentric rotation. This will cause the pivoting motion of the pivotable member 6 thereby to move the lower end portions of the diaphragms 4 up and down. When the lower end portion of one of the diaphragms 4, for example, is moved downward, negative pressure is generated inside the diaphragm 4, and the vent valve body 12 is tightly fitted to the inner wall face 11*a* of the annular concave groove 11. In this manner, the vent valve section V2 is closed, and the air intake valve body 8 opens the through hole 9. In other words, the air intake valve section V1 is shifted into an open state, and air is introduced from the intake hole 7*a* into the diaphragm 4, as shown by the arrow C.

Then, when the lower end portion of the diaphragm 4 is moved upward, high pressure is generated in the diaphragm 4, and the air intake valve body 8 closes the through hole 9, shifting the air intake valve section V1 into a closed state. At the same time, the vent valve body 12 is enlarged in diameter so as to depart from the inner wall face 11*a*, and the air is exhausted through the vent valve section V2, as shown by the arrow D. Specifically, the air exhausted from the vent valve body 12 passes the annular concave groove 11 and exhausted from the vent hole 10 to the exterior of the casing 2.

Also with the upward movement of the diaphragm 4, negative pressure is generated in the lower case 2*c*, and the air existing in the motor casing 20 flows into the lower case 2*c* via the communication hole 21, as shown by the arrow E. This generates negative pressure inside the motor casing 20, and the outside air is introduced into the motor casing 20 via the air intake hole 22, as shown by the arrow F.

In this manner, in the compact pump 23, the lower end portion of the eccentric rotation shaft 13 is pivoted inside the small diameter hole 26. Therefore, the pivoting motion of the lower end portion of the eccentric rotation shaft 13 can be made small. Consequently, the so-called rattling can be prevented, and noises will be remarkably eliminated.

Moreover, the small diameter hole 26 and the large diameter hole 27 can be easily formed.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A pump, comprising:

a plurality of diaphragms, which define a plurality of pump chambers;

a pivotable member, attached to the diaphragms;

a rotator, formed with a first hole having a first diameter, which is arranged eccentrically from a rotation center of the rotator, and a second hole having a second diameter smaller than the first diameter, which is formed in a bottom of the first hole;

a shaft member, which connects the rotator and the pivotable member so as to convert a rotation of the rotator into a pivotal movement of the pivotable member for sequentially deforming each diaphragm to vary a volume of each pressure chamber, wherein one end of the shaft member is fitted into the second hole.

2. The pump as set forth in claim 1, wherein a part of a circumferential edge of the first hole serves as a part of a circumferential edge of the second hole.

* * * * *